US006583548B2

(12) United States Patent
Cho et al.

(10) Patent No.: US 6,583,548 B2
(45) Date of Patent: Jun. 24, 2003

(54) IN-LINE TYPE ELECTRON GUN IN CATHODE RAY TUBE

(75) Inventors: Sung Ho Cho, Taegu-shi (KR); Soo Keun Lee, Kyongsangbuk-do (KR); Ok Tae Kim, Kyongsangbuk-do (KR); Dong Young Kim, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 98 days.

(21) Appl. No.: 09/840,236

(22) Filed: Apr. 24, 2001

(65) Prior Publication Data

US 2001/0050525 A1 Dec. 13, 2001

(30) Foreign Application Priority Data

May 16, 2000 (KR) ..... 2000-26107

(51) Int. Cl.[7] ..... H01J 29/50; H01J 29/74
(52) U.S. Cl. ..... 313/414; 313/439; 313/409
(58) Field of Search ..... 313/414, 415, 313/439, 444

(56) References Cited

U.S. PATENT DOCUMENTS 5,894,191 A * 4/1999 Kim ..... 313/414

* cited by examiner

*Primary Examiner*—Ashok Patel
*Assistant Examiner*—Sharlene Leurig
(74) *Attorney, Agent, or Firm*—Fleshner & Kim, LLP

(57) ABSTRACT

In-line type electron gun in a color cathode ray tube including a pre-focusing lens part having at least two electrodes for focusing electron beams, a main lens part having two, or more than two electrodes for focusing the electron beams onto a screen, and at least one electrostatic field controlling electrode in the electrodes of the main lens part having a center electron beam pass through hole and two outer electron beam pass through holes, wherein each of the outer electron beam pass through holes has a form a circular hole and a rectangular hole are combined therein, the rectangular hole having a height 'V2' greater than a vertical diameter 'V1' of the center beam pass through hole of the electrostatic field controlling electrode, thereby permitting an excellent focusing and improving assembly work.

36 Claims, 8 Drawing Sheets

IN-LINE TYPE ELECTRON GUN IN CATHODE RAY TUBE

BACKGROUND OF THE INVENTION

1. Field of the Invention

The present invention relates to a cathode ray tube, and more particularly, to an in-line type electron gun in a color cathode ray tube, which can improve a focusing characteristic.

2. Background of the Related Art

In general, electrodes in the in-line type electron guns are positioned at intervals to each other vertical to electron beam paths for controlling the electron beams to reach to a screen in a required form, which will be described in detail, with reference to FIG. 1 illustrating a section of a related art cathode ray tube.

Referring to FIG. 1, the in-line type electron gun is provided with three cathodes 10 independent from one another, a first electrode 11 which is a common electrode for the three cathodes, and a second electrode 12, a third electrode 13, a fourth electrode 14, a fifth electrode 15, and a sixth electrode 16, each spaced a distance away from each other. Moreover, there is a shield cup 17 above the sixth electrode 16, and there is a B.S.C (Bulb Space Connector) 18 attached to the shield cup for electrical connection of the electron gun to the tube and fastening the electron gun to a neck portion 3 of the tube. Accordingly, the electron beams 4 are emitted from heaters (not shown) each built-in the respective cathodes 10, controlled by the first electrode 11 which is a control electrode, accelerated by the second electrode 12 which is an accelerating electrode, pre-focused/accelerated by a pre-focus lens formed by the second electrode 12, the third electrode 13, the fourth electrode 14, and the fifth electrode 15, and mainly focused/accelerated by the fifth electrode 15 which is called as a focus electrode and the sixth electrode 16 which is called as an anode, both form a main lens. Then, the electron beams 4 pass through a shadow mask 1 which selects colors, and collide on a fluorescent surface 2, to make the fluorescent surface luminescent. Eventually, the electron beams 4 from the electron gun can form a picture by means of a deflection yoke, which deflects the electron beams to the entire screen.

FIG. 2 illustrates a perspective view of one example of a related art main lens forming electrode, and FIG. 3 illustrates a front view of an electrostatic field controlling electrode in the related art main lens forming electrode.

Referring to FIG. 2, the main lens forming electrode is provided with the focus electrode 15 and the anode 16, each with a rim part 15*a* and 16*a* in a form of a running track common for the three electron beams at positions to face each other, and the electrostatic field controlling electrode 25 and 26 as shown in FIG. 3 at a position inside of the focus electrode 15 or the anode 16. The electrostatic field controlling electrode 25 or 26 is a plate having three circular pass through holes 25*a* and 26*a*, for enlarging a main lens diameter.

The foregoing main lens forming electrode has the following problems.

Before explaining the problems, factors that give influences to a spot diameter on a picture will be explained. In general, as electron gun design criteria that influences the spot diameter on the picture, there are lens magnitudes, space charge repelling powers, and a main lens spherical aberration. The influence of the lens magnitude to the spot diameter Dx that can be utilized as the design criteria for the electron gun is little and has a slight effect too, because basic voltage conditions, focal distances, a length of the electron gun, and the like are fixed. As the space charge repelling power enlarges the spot diameter Dst owing to repellence and collision between the electrons, and it is favorable to design an angle of the electron beam divergence (called as a divergence angel) great for reducing the enlargement of the spot diameter Dst caused by the space charge repelling power. Opposite to this, the spherical aberration of the main lens, a characteristic representing an enlargement of the spot diameter Dic caused by a difference of focal distances of electrons passed through a radical axis and passed through a protaxis, forms the smaller spot diameter on the screen as the divergence angle is the smaller. In general, the spot diameter Dt on the screen can be expressed by using the following three parameters.

$$D_t = \sqrt{(D_x + D_{st})^2 + D_{ic}^2}$$

Particularly, as the best method for reducing the spherical aberration together with a reduction of the space charge repelling force, the main lens with a larger diameter is provided. However, the greater rim parts 15*a* and 16*a* and the greater depth of the electrostatic field controlling electrode 25 and 26 from the rim parts 15*a* and 16*a* to the electrostatic field controlling electrode 25 and 26 for providing a greater diametered main lens causes the following deterioration of the electron beam spot. As shown in FIG. 3, the electrostatic field controlling electrode 25 or 26 has pass through holes 25*a* and 26*b* for passing the three electron beams of R, G, B beams, wherein the center beam, the G beam, passes thorough the center beam pass through hole 25*b*, and the outer beams, R and B beams, pass through the outer beam pass through holes 25*a*, each a distance away from the center beam pass through hole 25*b* in opposite directions. That is, FIG. 4 illustrates forms of spots according to one exemplary related art main lens forming electrode.

Referring to FIG. 4, each of the spots formed by the outer electron beams has a form similar to an isosceles triangle, with an apex 'A' thereof at which two equal sides 'B' thereof meet together positioned at an outer side (an opposite side of the center beam side) and halos along the two equal sides thereof, that deteriorate the outer beam spots, because the rim part 15*a* of the focus electrode 15 weakens the focusing power at upper and lower portions of an inside portion of the outer beam (a center beam side) and enhances the focusing power at upper and lower portions of an outside (opposite sides of the center beam) of the outer beam. This may be explained extensively as follows. Alike a rubber ball with full of air, that bulges at the other side if one side is pressed, if the focusing power at the outside of the electron beam is enhanced, the focusing power of the inside of the electron beam is weakened, to show spot forms similar to the isosceles triangles on the screen. Moreover, there are fine halos formed along the two equal sides 'B'. Though the anode 16 can correct the spots of the outer beams slightly as the anode 16 acts opposite to the action of the focus electrode 15, since the main lens enhances the focusing power by the focus electrode more than acceleration by the anode, a spot form by the focusing power only is exhibited at the end.

FIG. 5 illustrates a perspective view of another example of a related art main lens forming electrode, FIG. 6A illustrates a front view of an electrostatic field controlling electrode in a focus electrode of a related art main lens forming electrode, and FIG. 6B illustrates a front view of an electrostatic field controlling electrode in an anode of a related art main lens forming electrode.

Referring to FIG. 5, another example of the related art main lens forming electrode 15 is provided with a focus electrode 15, an anode 16, rim parts 15*a* and 16*a* of track forms at opposite sides of the focus electrode 15 and the anode 16 respectively for three electron beams in common, and electrostatic field controlling electrodes 35 and 36 insides of the focus electrode 15 and the anode 16 at distances away from the rim parts as shown in FIGS. 6A and 6B, respectively. As shown in FIG. 6A, the electrostatic field controlling electrode 35 in the focus electrode 15 has a form of plate with three vertically elongated pass through holes 35*a* and 35*b*, for enlarging a diameter of the main lens. As shown in FIG. 6B, the electrostatic field controlling electrode 36 in the anode 16 has a form of plate with a circular pass through hole 36*a*, for accelerating the electron beams. The foregoing another example of the related art main lens forming electrode 15 has the following problems. Though the focusing of the focus electrode 15 in another example of the related art main lens forming electrode 15 is similar to the example, because the diverging action is very weak relative to the example owing to the weakened acceleration of the anode 16 coming from the position of the electrostatic field controlling electrode distanced far from the rim part 16*a*, the spot forms of the outer electron beams on the screen are exhibited as shown in FIG. 7 that is opposite to the FIG. 4.

In conclusion, the example and another example of the related art main lens forming electrodes have the following problems.

The difference between the center beam and the other beam caused by the main lens acting on the outer beams forms vertical fine halo at a central portion of the screen, and distorted spot forms at a peripheral region of the screen failing to focus a clear spot, thereby failing to make focusing meeting the requirements for high resolution, large sized screen, planarization of the screen, and provision of a large angled view.

In order to form the outer beam spots circular, the related art electron gun requires much care in assembly that results in drop of productivity of the electron gun, because formation of the one sided halo is sensitive to an accuracy of assembly of the electron gun with respect to alignment of the holes and a flatness of the electrodes.

SUMMARY OF THE INVENTION

Accordingly, the present invention is directed to an in-line type electron gun in a color cathode ray tube that substantially obviates one or more of the problems due to limitations and disadvantages of the related art.

An object of the present invention is to provide an in-line type electron gun in a color cathode ray tube, in which a structure of the main lens forming electrode is improved for an excellent focusing and improved assembly work.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the in-line type electron gun in a color cathode ray tube includes a pre-focusing lens part having at least two electrodes for focusing electron beams, a main lens part having two, or more than two electrodes for focusing the electron beams onto a screen, and at least one electrostatic field controlling electrode in the electrodes of the main lens part having a center electron beam pass through hole and two outer electron beam pass through holes, wherein each of the outer electron beam pass through holes has a form a circular hole and a rectangular hole are combined therein, the rectangular hole having a height 'V2' greater than a vertical diameter 'V1' of the center beam pass through hole of the electrostatic field controlling electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 8:
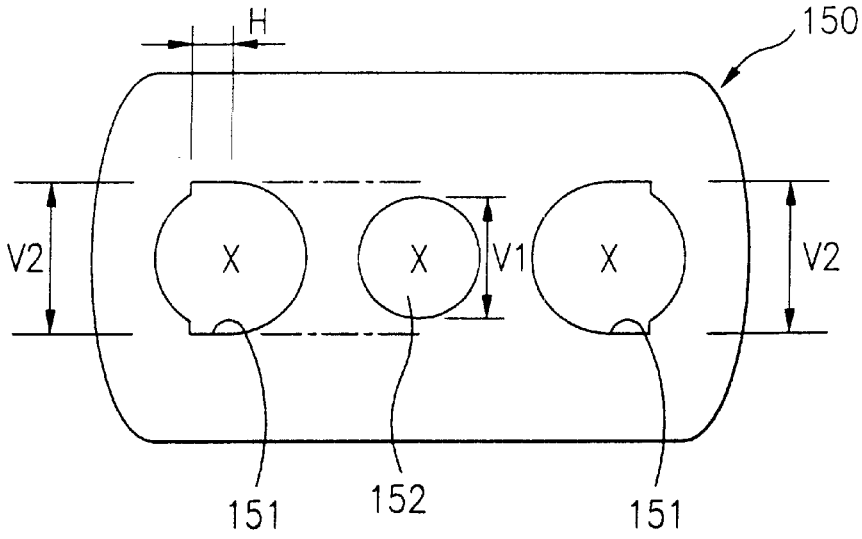
FIG. 8 illustrates a front view of an electrostatic field controlling electrode positioned on a pre-focus lens side among an electrostatic field controlling electrode of a main lens forming electrode in accordance with a preferred embodiment of the present invention.

Reference will now be made in detail to the preferred embodiments of the present invention, examples of which are illustrated in the accompanying drawings. FIG. 8 illustrates a front view of an electrostatic field controlling electrode positioned on a pre-focus lens side among an electrostatic field controlling electrode of a main lens forming electrode in accordance with a preferred embodiment of the present invention.

Figure 1:
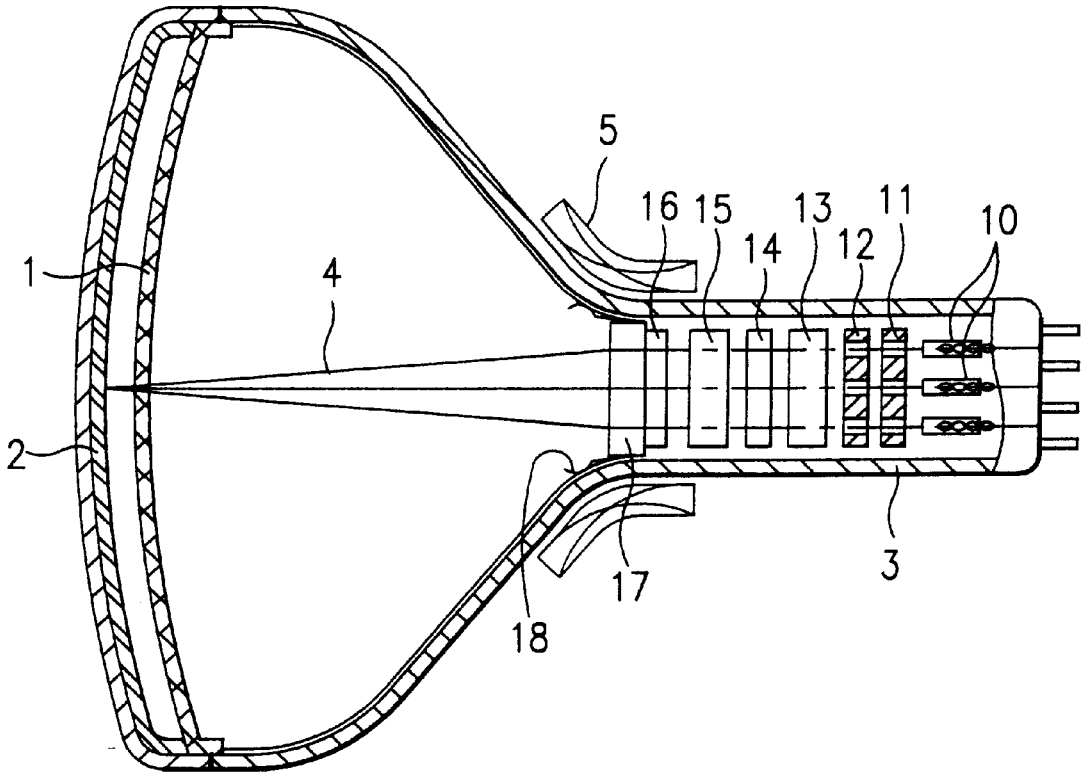
FIG. 1 Related Art
FIG. 1 illustrates a section of a related art cathode ray tube.
Figure 2:
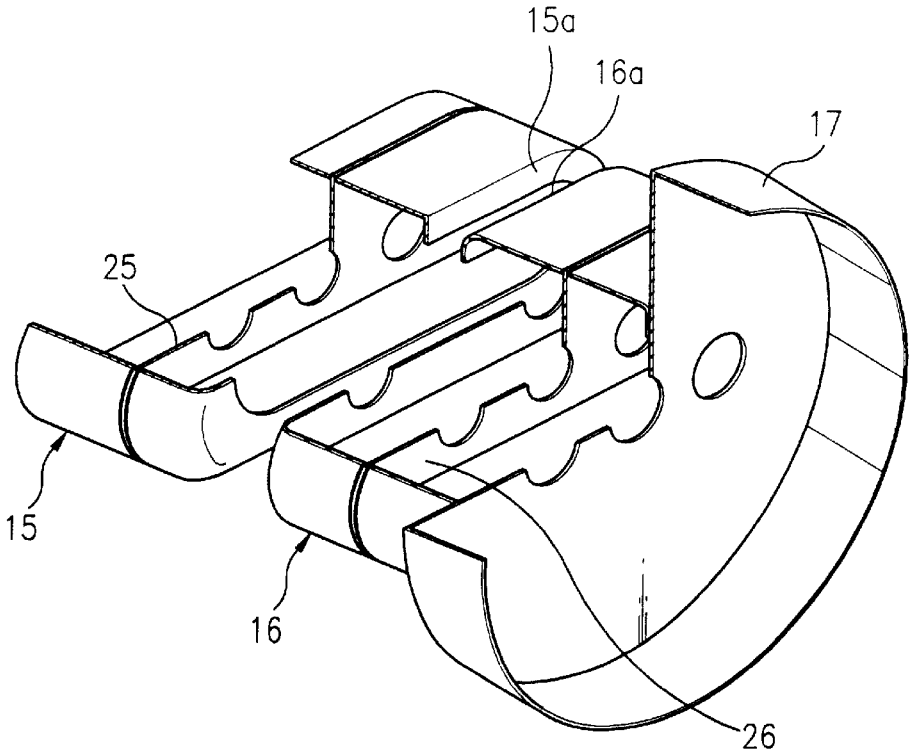
FIG. 2 Related Art
FIG. 2 illustrates a perspective view of one example of a related art main lens forming electrode.
Figure 11:
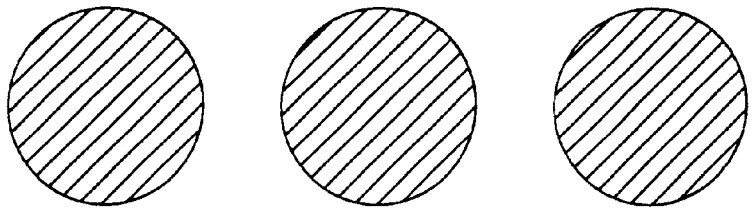
FIG. 11 illustrates spot forms of electron beams by an electrostatic field controlling electrode of the present invention.
Figure 13A:
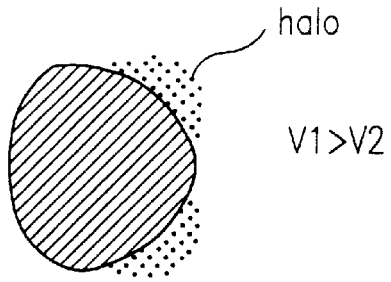
FIGS. 13A~13C illustrate spot forms varied with relative sizes of vertical diameters of the center hole and the outer hole.
Figure 13B:
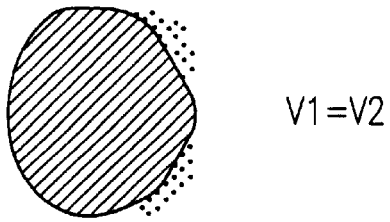
Figure 13C:
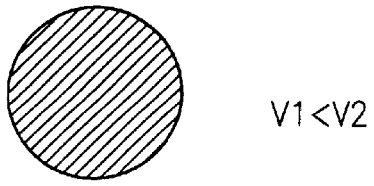

Referring to FIG. 8, the electrostatic field controlling electrode 150 includes a plate electrode located inside of a focus electrode (see FIG. 2) a distance away from a rim part (see 15*a* in FIG. 2) of the focus electrode having a circular center beam (G beam) pass through hole 152 and outer beam (R and B beams) pass through holes 151 each of a form of a circular hole combined with a rectangular hole. Particularly, each of the outer beam pass through holes 151 has a form of a circular hole having a rectangular hole combined to a semicircular portion of the circular hole on an opposite side of the center beam pass through hole with reference to a center of the circular hole, wherein the rectangular hole has a height 'V2' the same with a diameter of the circular hole and a width 'H' smaller than a radius of the circular hole. By changing the form of the electrostatic field controlling electrode 150, the weakening of the focusing power at upper and lower inside portions of each of the outer beams (i.e., upper and lower portions of the outer beams on the center beam sides) caused by the rim parts (see 15*a* in FIG. 2) can be corrected. That is, by combining the circular hole and the rectangular hole in forming the outer beam pass through holes 151 of the electrostatic field controlling electrode, the focusing power at upper and lower outside portions of the outer beams (i.e., upper and lower portions of the outer beams on sides opposite to the center beam) is weakened by the rectangular portions, to correct a difference of the focusing power caused by the rim parts. Moreover, a vertical diameter 'V2' of the outer beam pass through hole 151 is required to be greater than a vertical diameter 'V1' of the center beam pass through hole 152, for forming the outer beam spots close to a circle as shown in FIGS. 11 and 13C, otherwise the fine halos as shown in FIGS. 13A and 13B are resulted in from poor focusing.

Figure 12:
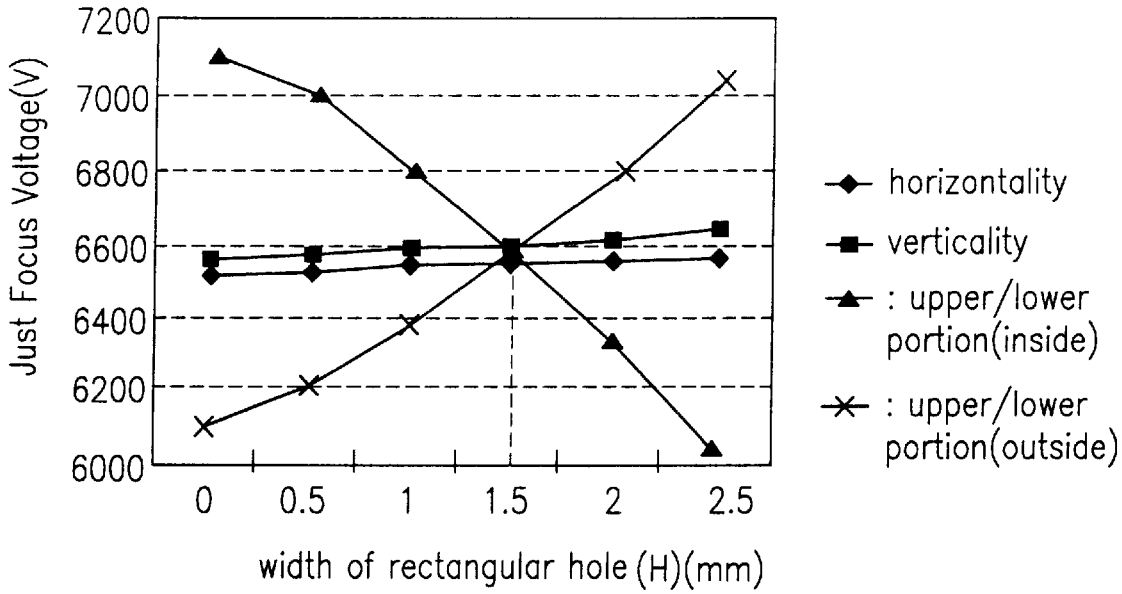
FIG. 12 illustrates a graph showing correlation between a width of rectangular hole formed in an electrostatic field controlling electrode of the present invention and just voltages in respective directions.

FIG. 12 illustrates a graph showing correlation between a width of rectangular hole formed in an electrostatic field controlling electrode of the present invention and just focus voltages in respective directions of peripheral spots, wherefrom it can be known that just focus voltages at the upper and lower portions of the inside portions (center beam sides) and outside portions (opposite sides of the center beam) of the outer beams are the same when the width 'H' of the rectangular hole is 1.5 mm, with a similar result for the vertical and horizontal direction focusing voltages. That is, as shown in FIG. 13C, it can be known that spot forms close to circles can be obtained on the screen. Together with this, since the foregoing electrostatic field controlling electrode 150 of the present invention permits to use a mandrel, a jig for supporting the electrodes, used in the related art during a beading process when the electrodes are fixed at required intervals by bead, the related art process is can be employed without change.

Figure 9:
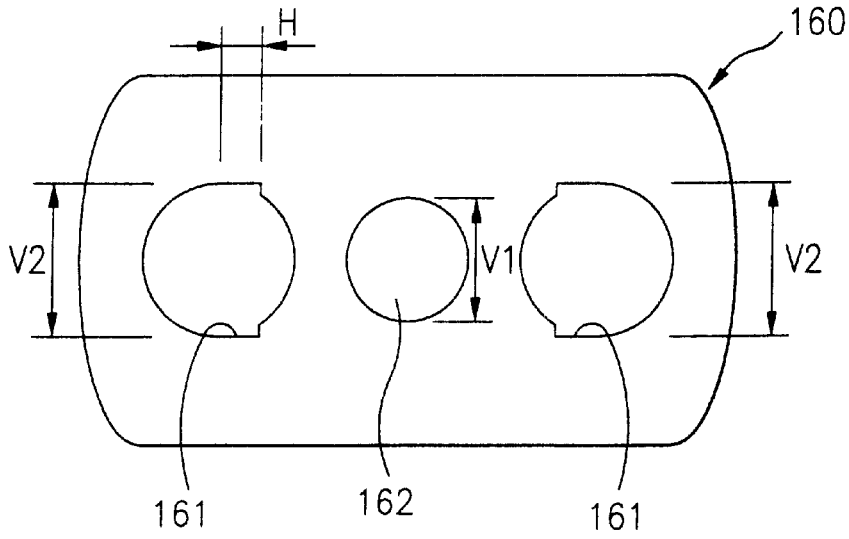
FIG. 9 illustrates a front view of an electrostatic field controlling electrode positioned on a screen side among an electrostatic field controlling electrode of a main lens forming electrode in accordance with a preferred embodiment of the present invention.

FIG. 9 illustrates a front view of an electrostatic field controlling electrode positioned on a screen side among an electrostatic field controlling electrode of a main lens forming electrode in accordance with a preferred embodiment of the present invention.

Referring to FIG. 9, when it is desired to modify triangular forms of the outer beam spots caused by the anode, an electrostatic field controlling electrode 160 in the anode is formed opposite to a form of the electrostatic field controlling electrode in the focus electrode (see FIG. 8). That is, each of the outer beam pass through holes 161 in the anode (see a reference numeral 16 in FIG. 2) has a form of a circular hole having a rectangular hole combined to a semicircular portion of the circular hole on a side of the center beam pass through hole with reference to the circular hole, wherein the rectangular hole has a height 'V2' the same with a diameter of the circular hole and a width 'H' smaller than a radius of the circular hole. According to this, the weakening of a diverging power of the outer beams at upper and lower portions of inside portions of the outer beams (portions of the outer beams on the center beam sides) can be corrected.

Figure 10:
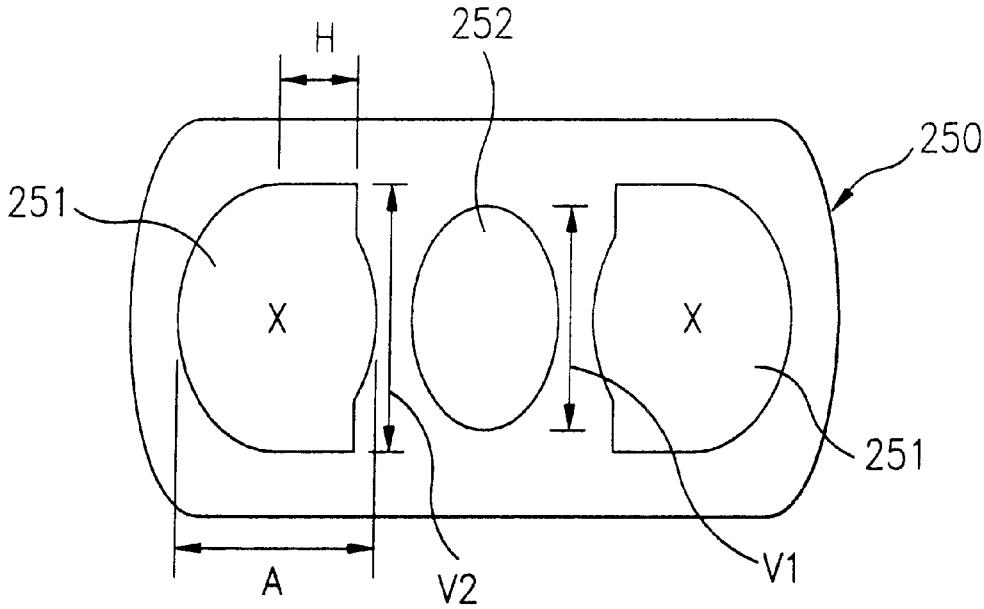
FIG. 10 illustrates a front view of an electrostatic field controlling electrode of a main electrode forming electrode in accordance with another preferred embodiment of the present invention.

FIG. 10 illustrates a front view of an electrostatic field controlling electrode of a main electrode forming electrode in accordance with another preferred embodiment of the present invention.

Figure 3:
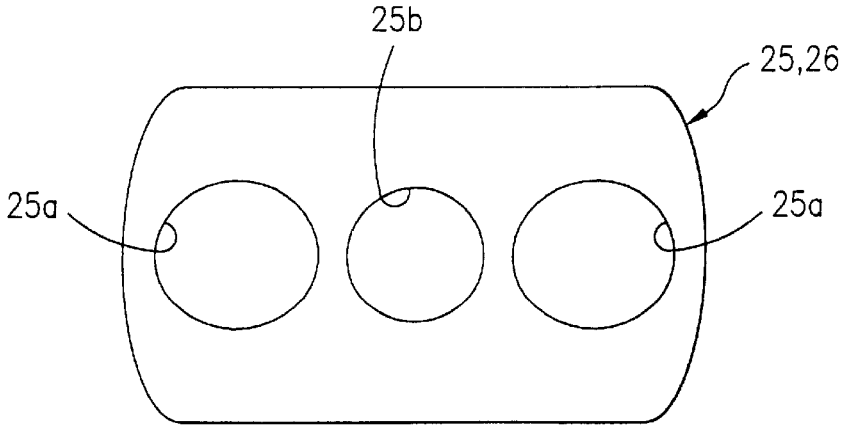
FIG. 3 Related Art
FIG. 3 illustrates a front view of an electrostatic field controlling electrode in the related art main lens forming electrode.
Figure 4:
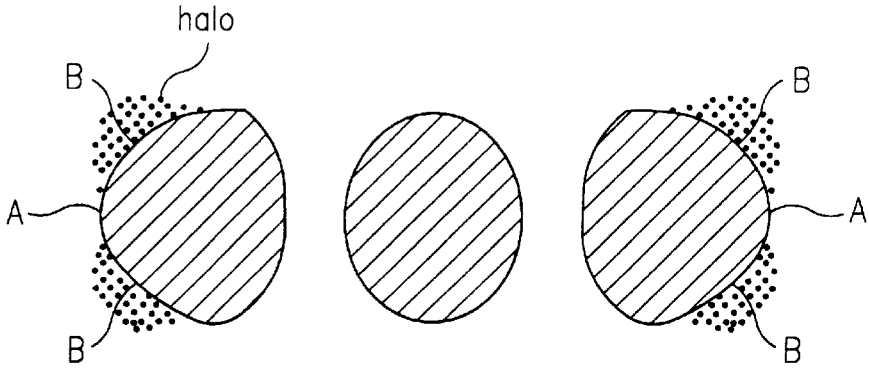
FIG. 4 Related Art
FIG. 4 illustrates forms of spots according to one exemplary related art main lens forming electrode.
Figure 5:
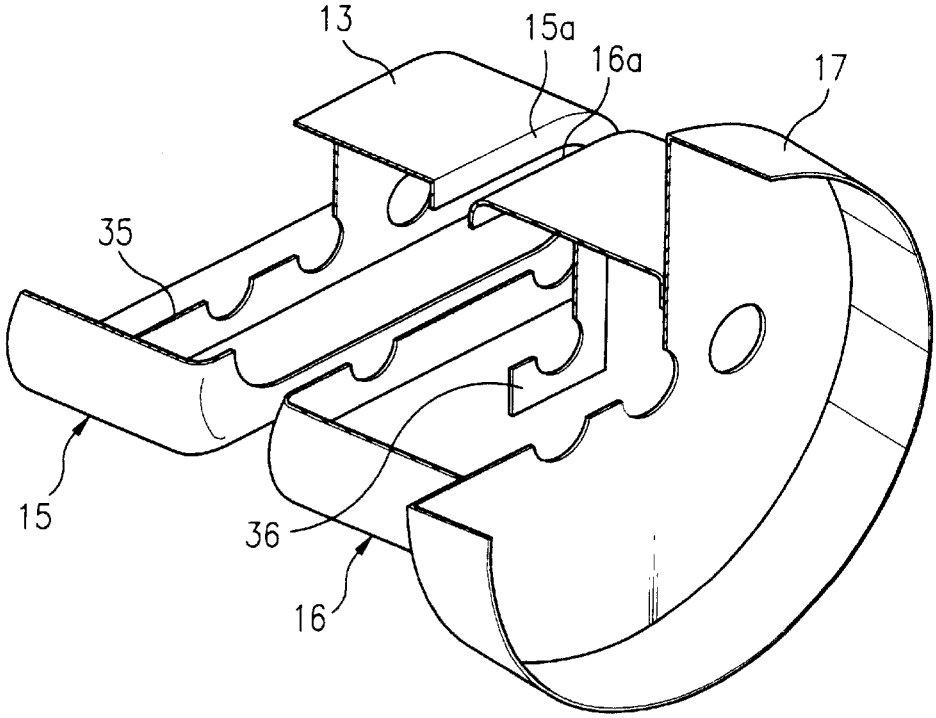
FIG. 5 Related Art
FIG. 5 illustrates a perspective view of another example of a related art main lens forming electrode.
Figure 6A:
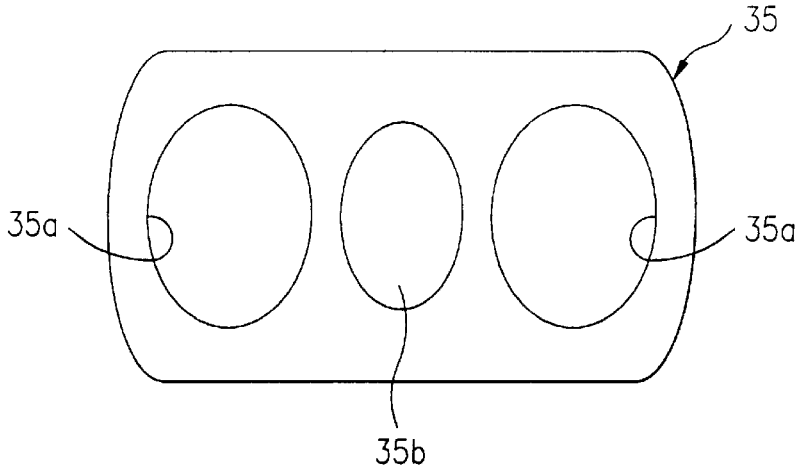
FIG. 6A Related Art
FIG. 6A illustrates a front view of an electrostatic field controlling electrode in a focus electrode of a related art main lens forming electrode.
Figure 6B:
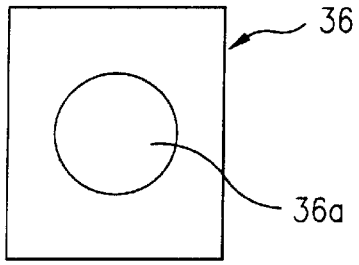
FIG. 6B Related Art
FIG. 6B illustrates a front view of an electrostatic field controlling electrode in an anode of a related art main lens forming electrode.
Figure 7:
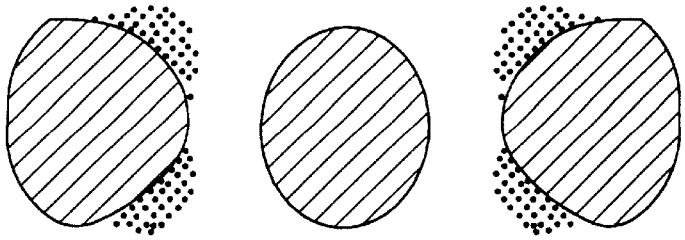
FIG. 7 Related Art
FIG. 7 illustrates spot forms of another exemplary related art main lens forming electrode, schematically.

Referring to FIG. 10, the electrostatic field controlling electrode 250 includes a plate formed electrode located inside of a focus electrode a distance away from a rim part of the focus electrode having an elliptical center beam pass through hole 252 and outer beam pass through holes 251 each of a form of an elliptical hole combined with a rectangular hole. Particularly, each of the outer beam pass through holes 251 has a form of an elliptical hole having a rectangular hole combined to a semi-elliptical hole portion of the elliptical hole on a side of the center beam pass through hole with reference to a center of the elliptical hole, wherein the rectangular hole has a height 'V2' the same with a vertical diameter of the elliptical hole and a width 'H' smaller than a half of a minor diameter of the elliptical hole. The form of the electrostatic field controlling electrode 250 is thus changed, because spot forms as shown in FIG. 7 opposite to FIG. 4 can be formed by over correcting differences of the focusing powers between upper and lower inside portions of the outer beams (i.e., upper and lower portions of the outer beams on the center beam sides) and upper and lower outside portions of the outer beams (i.e., upper and lower portions of the outer beams on sides opposite to the center beam) caused by the electrostatic field controlling electrode and the rim parts of the anode is over corrected. Accordingly, the elliptical hole and the rectangular hole are combined to form the outer beam pass through hole 251 of the electrostatic field controlling electrode, for weakening the focusing power at the inside portion (the center beam side) of the outer beams by means of the rectangular hole portion to correct the difference of focusing power caused by the rim part. As shown in FIGS. 11 and 13C, the height 'V2' of the rectangular hole of the outer beam 251 is required to be greater than a vertical diameter 'V1' of the center beam pass through hole 252, for forming spot forms of the outer beam close to circles, otherwise the spot forms have fine halos as shown in FIGS. 13A and 3B caused by poor focusing. As can be known from FIG. 12, just focus voltages at the upper and lower portions of the inside portions (center beam sides) and outside portions (opposite sides of the center beam) of the outer beams are the same when the width 'H' of the rectangular hole is 1.5 mm, with a similar result for the vertical and horizontal direction focusing voltages. That is, as shown in FIG. 13, it can be known that spot forms close to circles can be obtained on the screen.

As has been explained, the in-line type electron gun in a color cathode ray tube of the present invention has the following advantages.

The circular spots on the screen obtainable by changing forms of electron beam pass through holes of the electrostatic field controlling electrode permits to have an excellent focusing throughout entire screen. The use of the related art mandrel as it is facilitated by the present invention permits to use the related art fabrication process without any change, and an easy electron gun alignment. The circular spots on the screen obtainable in the present invention make the formation of the one sided halos less sensitive to the electron gun misalignment.

It will be apparent to those skilled in the art that various modifications and variations can be made in the in-line type electron gun in a color cathode ray tube of the present invention without departing from the spirit or scope of the invention. Thus, it is intended that the present invention cover the modifications and variations of this invention provided they come within the scope of the appended claims and their equivalents.

What is claimed is:

1. An in-line type electron gun in a color cathode ray tube, comprising:

a pre-focusing lens part having at least two electrodes for focusing electron beams;

a main lens part having two or more electrodes for focusing the electron beams onto a screen; and at least one electrostatic field controlling electrode in the electrodes of the main lens part having a center electron beam pass through hole and two outer electron beam pass through holes, wherein each of the outer electron beam pass through holes has a form of a circular hole and a rectangular hole combined therein, the rectangular hole having a height 'V2' greater than a vertical diameter 'V1' of the center beam pass through hole of the electrostatic field controlling electrode, wherein the center electron beam pass through hole is circular or elliptical.

2. The in-line type electron gun as claimed in claim 1, wherein each of the outer beam pass though holes in the electrostatic field controlling electrode located adjacent to the pre-focusing lens has the form of a rectangular hole combined to a semicircular hole portion of the circular hole located opposite to the center beam pass through hole with reference to the center of the circular hole.

3. The in-line type electron gun as claimed in claim 1, wherein each of the outer beam pass though holes in the electrostatic field controlling electrode located adjacent to the screen has the form of a rectangular hole combined to a semicircular hole portion of the circular hole located on a center beam pass through hole side with reference to the center of the circular hole.

4. The in-line type electron gun as claimed in claim 2, wherein the rectangular hole has a height the same as a diameter of the circular hole, and a width smaller than a radius of the circular hole.

5. The in-line type electron gun as claimed in claim 1, wherein each of the outer beam pass though holes in the electrostatic field controlling electrode located adjacent to the pre-focusing lens has the form of a rectangular hole combined to a semi-elliptical hole portion of an elliptical hole located opposite to the center beam pass through hole with reference to a center of the elliptical hole.

6. The in-line type electron gun as claimed in claim 5, wherein the rectangular hole has a height the same as a vertical diameter of the elliptical hole, and a width smaller than a half of a horizontal diameter of the elliptical hole.

7. An in-line type electron gun in a color cathode ray tube, comprising:

a pre-focusing lens part having at least two electrodes for focusing electron beams;

a main lens part having two or more electrodes for focusing the electron beams onto a screen; and at least one electrostatic field controlling electrode in the electrodes of the main lens part having a center electron beam pass through hole and two outer electron beam pass through holes, wherein each of the outer electron beam pass through holes has the form of a circular hole and a rectangular hole combined, wherein the rectangular hole has a height substantially the same as a diameter of the circular hole, and a width smaller than a radius of the circular hole.

8. An in-line type electron gun in a color cathode ray tube, comprising:

a pre-focusing lens part having at least two electrodes for focusing electron beams;

a main lens part having two or more electrodes for focusing the electron beams onto a screen; and at least one electrostatic field controlling electrode in the electrodes of the main lens part having a center electron beam pass through hole and two outer electron beam pass through holes, wherein each of the outer beam pass through holes has the form of a rectangular hole combined with a semi-elliptical hole portion of an elliptical hole located opposite to the center beam pass through hole with reference to a center of the elliptical hole, and wherein the rectangular hole has a height substantially the same as a vertical diameter of the elliptical hole, and a width smaller than a half of a horizontal diameter of the elliptical hole.

9. An in-line type electron gun in a color cathode ray tube, comprising:

a pre-focusing lens part having at least two electrodes for focusing electron beams;

a main lens part having two or more electrodes for focusing the electron beams onto a screen; and at least one electrostatic field controlling electrode in the electrodes of the main lens part having a center electron beam pass through hole and two outer electron beam pass through holes, wherein each of the outer beam pass through holes has the form of a rectangular hole combined with a semi-elliptical hole portion of an elliptical hole located opposite to the center beam pass through hole with reference to a center of the elliptical hole, and wherein the center electron beam pass through hole is circular.

10. An in-line type electron gun in a color cathode ray tube, comprising:

a pre-focusing lens part having at least two electrodes for focusing electron beams;

a main lens part having two or more electrodes for focusing the electron beams onto a screen; and at least one electrostatic field controlling electrode in the electrodes of the main lens part having a center electron beam pass through hole and two outer electron beam pass through holes, wherein each of the outer beam pass through holes has the form of a rectangular hole combined with a semi-elliptical hole portion of an elliptical hole located opposite to the center beam pass through hole with reference to a center of the elliptical hole, and wherein the center electron beam pass through hole is elliptical.

11. An electron gun in a cathode ray tube, comprising:

a main lens part configured to focus electron beams onto a screen, the main lens part including at least one electrostatic field controlling electrode having a center electron beam pass through hole and at least two outer electron beam pass through holes, wherein each of the two outer electron beam pass through holes comprises two partially circular hole portions joined together, the two partially circular hole portions having different radii.

12. The electron gun in a cathode ray tube as claimed in claim 11, further comprising a pre-focusing lens part disposed adjacent to the main lens part.

13. The electron gun in a cathode ray tube as claimed in claim 11, wherein the main lens part comprises two or more electrodes configured to focus electron beams onto a screen.

14. The electron gun in a cathode ray tube as claimed in claim 11, wherein the two partially circular hole portions are joined by a rectangular hole portion.

15. The electron gun in a cathode ray tube as claimed in claim 11, wherein the two partially circular hole portions comprise a semicircular hole portion and an arc hole portion joined together.

16. The electron gun in a cathode ray tube as claimed in claim 15, wherein the semicircular hole portion and the arc hole portion are joined by a rectangular hole portion.

17. The electron gun in a cathode ray tube as claimed in claim 16, wherein a height of the rectangular hole portion is the same as a diameter of the semicircular hole portion, and a width is smaller than a radius of the arc hole portion.

18. The electron gun in a cathode ray tube as claimed in claim 15, wherein the semicircular hole portion is located opposite the center beam pass through hole with respect to a center of the outer electron beam pass through hole.

19. The electron gun in a cathode ray tube as claimed in claim 11, wherein the center electron beam pass through hole is circular.

20. An electron gun in a cathode ray tube, comprising:

a main lens part configured to focus electron beams onto a screen, the main lens part including at least one electrostatic field controlling electrode having a center electron beam pass through hole and at least two outer electron beam pass through holes, wherein each of the two outer electron beam pass through holes comprises two partial elliptical hole portions joined together, the two partially elliptical hole portions having different vertical diameters.

21. The electron gun in a cathode ray tube as claimed in claim 20, further comprising a pre-focusing lens part disposed adjacent to the main lens part.

22. The electron gun in a cathode ray tube as claimed in claim 20, wherein the main lens part comprises two or more electrodes configured to focus electron beams onto a screen.

23. The electron gun in a cathode ray tube as claimed in claim 20, wherein the two partial elliptical hole portions are joined by a rectangular hole portion.

24. The electron gun in a cathode ray tube as claimed in claim 20, where the two partial elliptical hole portions comprise a semi-elliptical hole portion and a partial elliptical hole portion joined together.

25. The electron gun in a cathode ray tube as claimed in claim 24, wherein the semi-elliptical hole portion and the partial elliptical hole portion are joined by a rectangular hole portion.

26. The electron gun in a cathode ray tube as claimed in claim 25, wherein a height of the rectangular hole portion is the same as a vertical diameter of the semi-elliptical hole portion, and a width is smaller than a horizontal diameter of the partial elliptical hole portion.

27. The electron gun in a cathode ray tube as claimed in claim 24, wherein the semi-elliptical hole portion is located opposite the center beam pass through hole with respect to a center of the outer electron beam pass through hole.

28. The electron gun in a cathode ray tube as claimed in claim 20, wherein the center electron beam pass through hole is circular.

29. An in-line type electron gun in a color cathode ray tube, comprising:

a pre-focusing lens part having at least two electrodes for focusing electron beams;

a main lens part having two or more electrodes for focusing the electron beams onto a screen; and at least one electrostatic field controlling electrode in the electrodes of the main lens part having a center electron beam pass through hole and two outer electron beam pass through holes, wherein each of the outer electron beam pass through holes has a form of a circular hole and a rectangular hole combined therein, the rectangular hole having a height 'V2' greater than a vertical diameter 'V1' of the center beam pass through hole of the electrostatic field controlling electrode, wherein the electrostatic field controlling electrode has a substantially constant thickness.

30. The in-line type electron gun as claimed in claim 29, wherein each of the outer beam pass though holes in the electrostatic field controlling electrode located adjacent to the pre-focusing lens has the form of a rectangular hole combined to a semicircular hole portion of the circular hole located opposite to the center beam pass through hole with reference to the center of the circular hole.

31. The in-line type electron gun as claimed in claim 29, wherein each of the outer beam pass though holes in the electrostatic field controlling electrode located adjacent to the screen has the form of a rectangular hole combined to a semicircular hole portion of the circular hole located on a center beam pass through hole side with reference to the center of the circular hole.

32. The in-line type electron gun as claimed in claim 29, wherein the rectangular hole has a height the same as a diameter of the circular hole, and a width smaller than a radius of the circular hole.

33. The in-line type electron gun as claimed in claim 29, wherein each of the outer beam pass though holes in the electrostatic field controlling electrode located adjacent to the pre-focusing lens has the form of a rectangular hole combined to a semi-elliptical hole portion of an elliptical hole located opposite to the center beam pass through hole with reference to a center of the elliptical hole.

34. The in-line type electron gun as claimed in claim 33, wherein the rectangular hole has a height the same as a vertical diameter of the elliptical hole, and a width smaller than a half of a horizontal diameter of the elliptical hole.

35. The in-line type electron gun as claimed in claim 33, wherein the center electron beam pass through hole in the electrostatic field controlling electrode is circular.

36. The in-line type electron gun as claimed in claim 33, wherein the center electron beam pass through hole in the electrostatic field controlling electrode is elliptical.

* * * * *